United States Patent [19]

Voshall

[11] Patent Number: 4,797,522

[45] Date of Patent: Jan. 10, 1989

[54] VACUUM-TYPE CIRCUIT INTERRUPTER

[75] Inventor: Roy E. Voshall, Monroeville, Pa.

[73] Assignee: Westinghouse Electric Corp., Pittsburgh, Pa.

[21] Appl. No.: 165,067

[22] Filed: Feb. 11, 1988

[51] Int. Cl.[4] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 3,705,281 | 12/1972 | Luehring | 200/144 B |
| 3,720,798 | 3/1973 | Kabayama et al. | 200/144 B |
| 3,836,740 | 9/1974 | Hundstat | 200/144 B |
| 3,996,437 | 12/1976 | Selzer | 200/144 B |
| 3,997,748 | 12/1976 | Harris | 200/144 B |
| 4,171,474 | 10/1979 | Holmes | 200/144 B |
| 4,210,790 | 7/1980 | Kurosawa | 200/144 B |
| 4,345,126 | 8/1982 | Cherry | 200/144 B |
| 4,394,554 | 7/1983 | Warabi | 200/144 B |
| 4,408,107 | 12/1983 | Sukuma | 200/144 B |
| 4,414,448 | 11/1983 | Kashimoto | 200/144 B |
| 4,431,885 | 2/1984 | Sukuma | 200/144 B |
| 4,471,184 | 9/1984 | Sano | 200/144 B |
| 4,481,390 | 11/1984 | Kashiwagi | 200/144 B |
| 4,542,266 | 9/1985 | Haessler et al. | 200/144 B |
| 4,661,666 | 4/1987 | Sakuma et al. | 200/144 B |
| 4,743,718 | 5/1988 | Santilli | 200/144 B |

OTHER PUBLICATIONS

Journal of Applied Physics, vol. 40, pp. 1744 to 1752, Mar. 1969, – Author C. W. Kimblin, "Anode Voltage Drop and Anode Spot Formation in DC Vacuum Arcs".

*Primary Examiner*—Robert S. Macon

*Attorney, Agent, or Firm*—J. L. Morrison; B. K. Niyogi

[57] ABSTRACT

A vacuum circuit interrupter comprising an insulated, evacuated, cylindrical housing for a stationary electrode and a movable electrode, with an arc shield provided with a predetermined spacing from and connected to the stationary electrode. The dimensions of the electrodes are asymmetrical with the movable electrode being smaller.

4 Claims, 1 Drawing Sheet

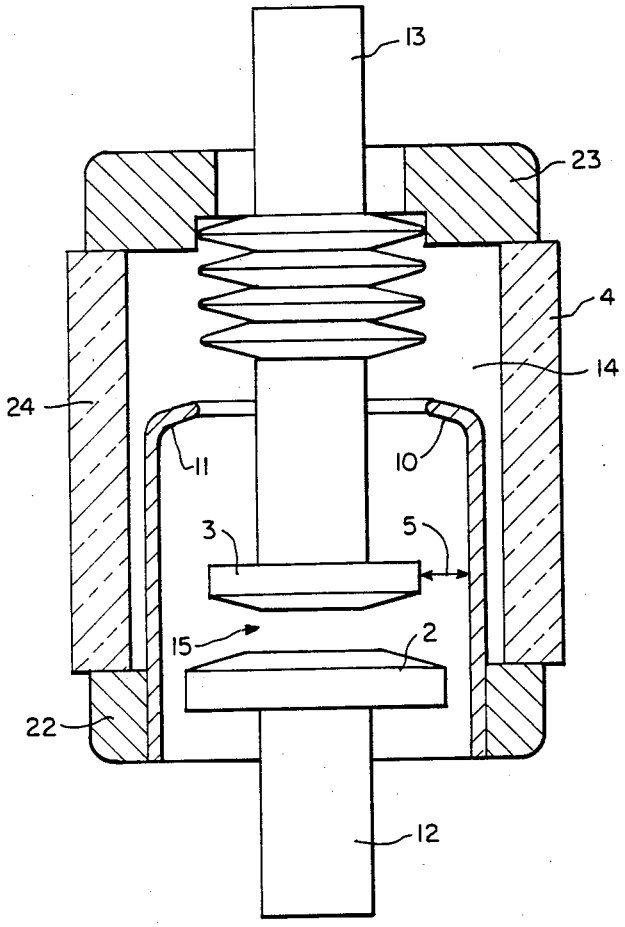
13
23
4
14
24
11
10
3
5
15
2
22
12

VACUUM-TYPE CIRCUIT INTERRUPTER

TECHNICAL FIELD

This invention relates to a vacuum-type circuit interrupter, and in particular to a vacuum circuit interrupter with non-floating arc shield and asymmetric electrodes.

BACKGROUND OF THE INVENTION

It is known that vacuum-type circuit interrupters generally comprise an evacuated insulated envelope with separable contacts disposed within the insulated envelope. The contacts are movable between a closed position of the circuit interrupter in which the contacts are firmly engaged and in an open position of the circuit interrupter when the contacts are separated to establish an arc gap therebetween. During separation of the contacts, it is known, that a resulting arc discharges arc erosion products from the electrodes emitting and depositing these undesirable products on inner surface walls and arc shields are provided for that purpose. Vacuum-type circuit interrupters are disclosed in U.S. Pat. No. 4,210,790 in which a pair of relatively opposed electrodes are provided with each electrode having an annular contact making section.

Another vacuum-type circuit interrupter is disclosed in U.S. Pat. No. 3,997,748 in which the pair of primary electrodes are protected and surrounded by a shield from electrode erosion and weld forces. Other related vacuum-type circuit interrupter matters are disclosed in U.S. Pat. Nos. 4,431,885; 4,408,107; 4,414,448; 4,481,390; 4,394,554; and 4,345,126.

It is generally known that the arc shield prevents metal vapor emitted from the arcing region between the electrodes from depositing on an insulating wall of a vacuum-envelope. For high voltage vacuum circuit interrupters, the arc shield is electrically floating and the construction of the electrodes and contacts are symmetrical. However, as vacuum-type circuit interrupters are made smaller in length and diameter, a low cost construction is used in which the arc shield is tied to one of the end flanges of the circuit interrupter and one of the electrodes is placed close to this end of the circuit interrupter.

In the Journal of Applied Physics, Volume 40, pages 1744 to 1752, March, 1969, C. W. Kimblin has in an article entitled "Anode Voltage Drop and Anode Spot Formation in D.C. Vacuum Arcs" has discussed and shown that the current at which an anode spot will be formed is directly related to the anode arcing area for a given electrode separation. Consequently, the larger the anode area, the higher the arcing current must be before an anode spot will occur. Uncontrollable anode spots cause gross erosion of the electrodes and will deteriorate the current interruption level.

SUMMARY OF THE INVENTION

The present invention discloses the novel technique of having a vacuum circuit interrupter with an insulated housing containing a stationary electrode cooperating with a movable electrode and an arc shield surrounding the stationary electrode. The arc shield is located and provided with a predetermined spacing between the movable electrode and the arc shield, along with the movable electrode being formed with a predetermined smaller dimension with respect to the stationary electrode and characterized by asymmetric shaped electrode structures so as to provide the predetermined spacing between the arc shield and the movable electrode.

An object of the invention is to provide a vacuum circuit interrupter arrangement with asymmetric electrodes with an arc shield connected to an end flange of the stationary electrode, in which the stationary electrode is made as large as possible whilst the movable electrode is made smaller for voltage clearances.

Consequently, the arcing anode has a much larger arcing area than the known conventional type vacuum circuit interrupters, resulting in the current interruption capacity being increased.

BRIEF DESCRIPTION OF THE DRAWINGS

For a better understanding of the invention, the invention will now be described, by way of example, with reference to the accompanying drawing which is a sectional view showing the construction of a vacuum-type circuit interrupter employing a pair of asymmetrical shaped electrode structures to which the present invention is directed.

Referring to the drawing, a pair of contacts or electrodes 2 and 3 are securely fixed to one end of a pair of support rods or holders 12 and 13 of electrical conductors respectively within a sealed envelope 14. The electrically conductive holders 12 and 13 extend at their respective ends toward the exterior of the sealed envelope 14 through a pair of end plates 22 and 23 respectively. The sealed envelope 14 comprises a cylindrical casing 4 constituting a pair of a cylindrical housing 24 of electrical insulator the opposite ends of which are sealed by the end plates 22 and 23. The conductive holder 12 extends to the stationary electrode 2 and the conductive holder 13 is movable with the electrode 3 towards the stationary electrode 2 and defines an arc gap 15.

A non-floating arc shield 11 is fixed to the end plate 22, and is electrically connected to the conductor 12, and is supported in the middle portion of an internal space of the cylindrical housing 24. The shield 11 is so adapted as to surround the electrodes 2 and 3. The electrode 3 which is the movable electrode should be smaller than the stationary electrode 2 so that there is a predetermined spacing 5 between the arc shield and the movable electrode 3. This predetermined spacing 5 must be sufficient to withstand voltage surges as well as transient recovery voltage.

The arc shield 11 preferably should be made of the same material as the electrodes. The ends 10 of the arc shield 11 is curved inwardly so as to prevent during electrode separation the erosion and arc metal vapors from the electrodes from depositing on the inner wall of said cylindrical housing 24. This is essential for the circuit interrupter to maintain proper voltage withstand through the useful life of the circuit interrupter.

For higher current interruption capability, the electrodes should be equipped with slots (not shown) to produce a magnetic drive on an arc. This drive should be in an azimuthal direction. Tests have shown that when the arc shield is connected to the arcing anode, current interruption is more favorable than when this electrode is the arcing cathode. The reason that the arcing anode has a large area consisting of the electrode plus the arc shield, therefore, the rated AC current interruption characteristics of this interrupter are when the electrodes are parted on a current loop such that the large electrode and shield are the arcing anode, current interruption should occur at the first current zero crossing. When the electrodes are parted on a current loop such that the large electrode and shield are the arcing cathode, the current may not be interrupted at the first current zero but will definitely be interrupted at the next current zero.

Vacuum circuit interrupters with asymmetrical size electrodes have advantages in that the current interruption capacity of a given size of interrupter having non-floating arc shields should be greater with asymmetrical electrodes than those of symmetric electrodes provided the former interrupter has the larger electrode of maximum diameter. The asymmetric electrode interrupter may be a low cost improvement to increase the current interruption rating of a given size vacuum interrupter.

I claim:

1. A vacuum circuit interrupter comprising (a) an insulated cylindrical evacuated housing;

(b) a stationary electrode in said housing;

(c) a movable electrode in said housing adapted to engage said stationary electrode so as to provide an arc on separation;

(d) an arc shield surrounding the stationary electrode and electrically connected thereto extending toward the movable electrode to provide a predetermined spacing between the arc shield and the movable electrode; and (e) in which the movable electrode is of a smaller dimension with respect to the stationary electrode so as to form asymmetric shaped electrode structures, whereby to provide the predetermined spacing between the arc shield and the movable electrode.

2. A vacuum circuit interrupter as claimed in claim 1, in which the arc shield and the electrodes are of the same material.

3. A vacuum circuit interrupter as claimed in claim 2, in which the open end of the arc shield is curved inwardly so as to prevent the erosion and arc metal vapors from the electrodes from depositing on inner surface of said insulated cylindrical housing.

4. A vacuum circuit interrupter as claimed in claim 1, 2, or 3, in which the electrode surfaces are formed with slots so as to produce a magnetic drive on the resulting arc caused by the electrodes on separation.

* * * * *